US008162420B2

(12) United States Patent
Chen et al.

(10) Patent No.: US 8,162,420 B2
(45) Date of Patent: Apr. 24, 2012

(54) SLIDE ASSEMBLY HAVING AN ADJUSTMENT MECHANISM

(75) Inventors: Ken-Ching Chen, Kaohsiung Hsien (TW); I-Ming Tseng, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 373 days.

(21) Appl. No.: 12/588,511

(22) Filed: Oct. 19, 2009

(65) Prior Publication Data

US 2010/0039009 A1 Feb. 18, 2010

Related U.S. Application Data

(63) Continuation-in-part of application No. 11/489,684, filed on Jul. 20, 2006, now abandoned.

(51) Int. Cl.
*A47B 88/04* (2006.01)

(52) U.S. Cl. ..... 312/348.4; 312/334.1

(58) Field of Classification Search ..... 312/330.1, 312/334.1, 334.4, 334.7, 348.4; 403/245, 403/408.1, 409.1; 384/22
See application file for complete search history.

(56) References Cited

U.S. PATENT DOCUMENTS

| | | | | |
|---|---|---|---|---|
| 4,291,929 | A * | 9/1981 | Faust | 312/334.4 |
| 4,595,245 | A * | 6/1986 | Rock et al. | 312/265.1 |
| 4,705,328 | A * | 11/1987 | Rock et al. | 312/330.1 |
| 4,850,659 | A * | 7/1989 | Rock et al. | 312/263 |
| 4,995,683 | A * | 2/1991 | Albiez | 312/348.4 |
| 5,163,774 | A * | 11/1992 | Lautenschlager | 403/245 |
| 6,585,336 | B2 * | 7/2003 | Munday et al. | 312/334.4 |
| 6,923,518 | B2 * | 8/2005 | Kim | 312/334.4 |
| 2004/0239221 | A1 * | 12/2004 | Yang | 312/334.46 |

* cited by examiner

*Primary Examiner* — James O Hansen
(74) *Attorney, Agent, or Firm* — Rosenberg, Klein & Lee

(57) ABSTRACT

A slide assembly having an adjustment mechanism includes an inner rail, an adjusting lever, and a guide block. The inner rail includes a first slot, a pivoting portion, and a second slot thereon. The adjusting lever includes a first hole, a middle section pivoted to the inner rail, and a second hole. The first hole corresponds in position to the first slot, and the second hole corresponds in position to the second slot. The guide block is pivoted to the second hole of the adjusting lever. A protruding portion is eccentrically disposed on the guide block. The protruding portion is moved to lean against a portion of the second slot by turning the guide block. The adjusting lever deflects and the first hole slides in relation to the first slot. A fastening member penetrates through the first hole to connect a drawer or similar object so that the drawer can be tuned fine for a higher or lower position.

1 Claim, 4 Drawing Sheets

SLIDE ASSEMBLY HAVING AN ADJUSTMENT MECHANISM

This is a continuation-in-part application of application Ser. No. 11/489,684 filed on Jul. 20, 2006, now abandoned.

BACKGROUND OF THE INVENTION (a) Field of the Invention

The present invention relates to a slide assembly having an adjustment mechanism, and more particularly, to one that is capable of fine-tuning for the position of the slide assembly in relation to a drawer or deck incorporated to the slide assembly.

(b) Description of the Prior Art

The prior art of adjustment method for a drawer or similar object mounted to a retractable slide is taught in U.S. Pat. Nos. 4,291,929, 6,585,336 B2, and 6,923,518 B2, and Taiwanese Patent No. 1250002 (a patent same as that of U.S. Pat. No. 6,923,518 B2.) Among the cases cited, some require comparatively larger space for assembly (i.e., the combination of worm and worm gear) and others require greater operating force to be applied to wrench an adjustment member, which is much more laborious.

SUMMARY OF THE INVENTION

The primary purpose of the present invention is to provide a slide assembly having an adjustment mechanism that allows easy adjustment simply by using a hand tool to fine tune the position of the slide assembly in relation to a drawer or deck incorporated to the slide assembly.

To achieve the purpose, the present invention includes an outer rail, an inner rail, an adjusting lever and a guide block. The inner rail includes a first slot, a pivoting portion, and a second slot thereon. The adjusting lever comprises a first hole, a middle section, and a second hole. The middle section is pivoted to the pivoting portion of the inner rail. The first hole of the adjusting lever corresponds in position to the first slot of the inner rail, and the second hole of the adjusting lever corresponds in position to the second slot of the inner rail. The guide block is pivoted to the second hole of the adjusting lever. A protruding portion is disposed at the bottom of the guide block and corresponds to the second slot of the inner rail. Accordingly, the protruding portion is moved against a portion of the second slot by turning the guide block and the adjusting lever defects with its middle section where pivoted to the pivoting portion as the axis, while the first hole of the adjusting lever slides in relation to the first slot. Wherein, the protruding portion of the guide block is eccentrically disposed; a head portion is disposed on the top of the guide block; a pivoting hole is disposed at the middle section, and the pivoting portion of the inner rail is in the form of a hollow tube to penetrate through the pivoting hole for installation.

The present invention allows easy and laborsaving operation, in compact construction to allow easier mounting onto the rail.

DETAILED DESCRIPTION OF THE PREFERRED EMBODIMENTS

Figure 1:
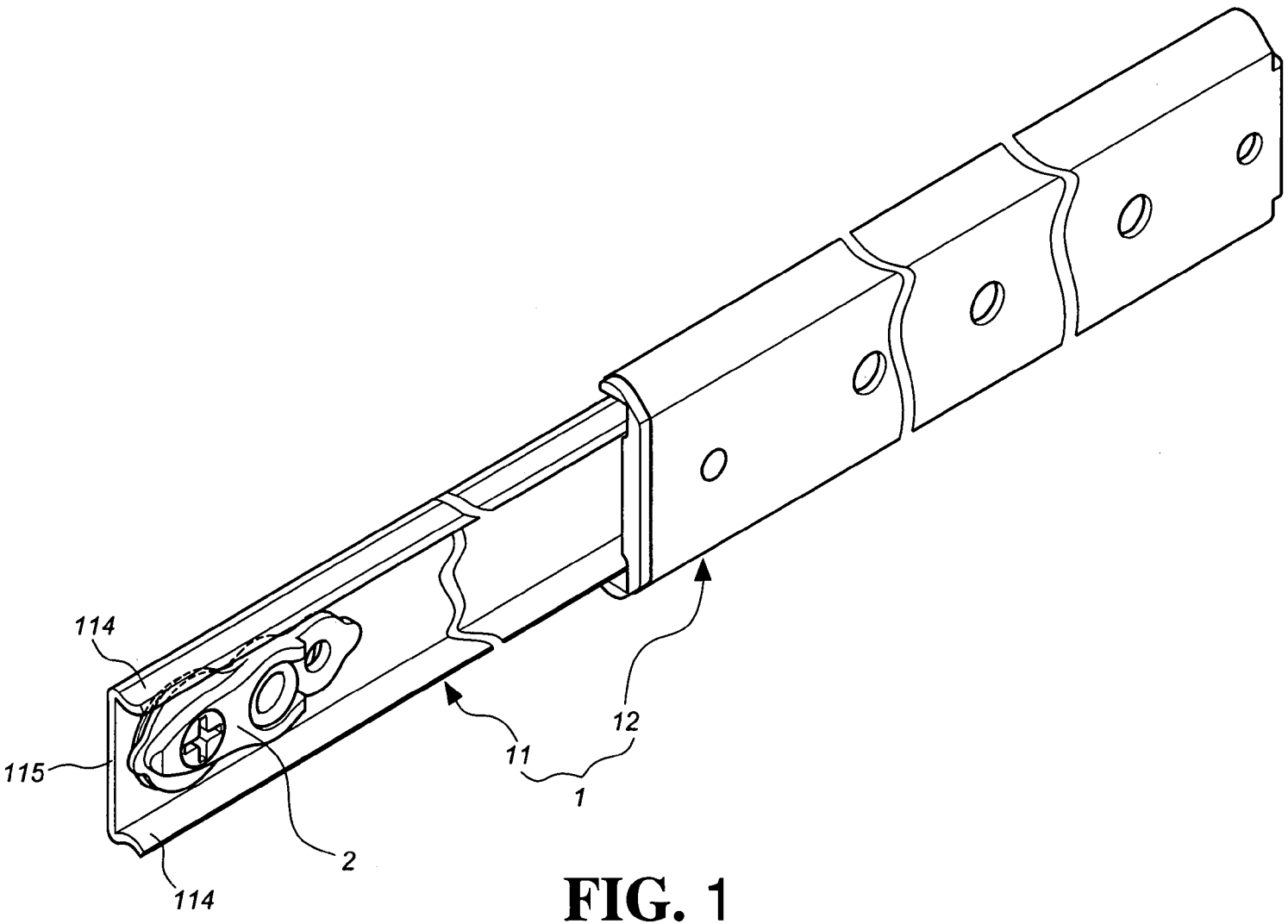
FIG. 1 is a perspective view of a preferred embodiment of the present invention.
Figure 2:
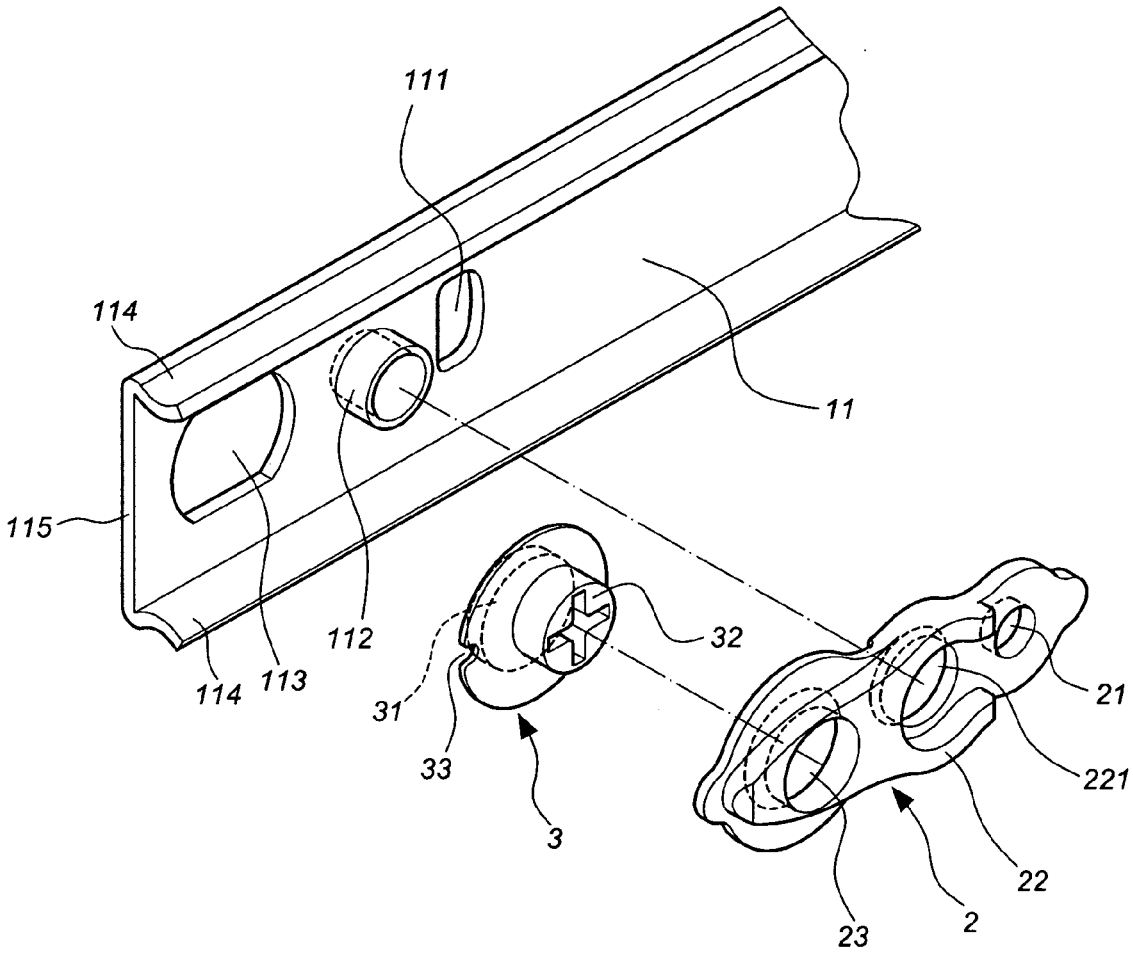
FIG. 2 is an exploded view of the preferred embodiment of the present invention.

Referring to FIGS. 1 and 2, a preferred embodiment of the present invention includes a slide assembly (1), an adjusting lever (2), and a guide block (3).

The slide assembly (1) comprises an outer rail (12) and an inner rail (11) which is slidably connected to the outer rail (12). The inner rail (11) includes a pair of side walls (114) and a web portion (115) extending between the pair of s side walls (114). An end of the web portion (115) of the inner rail (11) is formed with a first slot (111), a second slot (113), and a pivoting portion (112) between the first slot (111) and the second slot (113). The first slot (111) of the inner rail (11) is in the form of a vertical slot. The second slot (113) of the inner rail (11) is in the form of a horizontal slot. The pivoting portion (112) is in the form of a hollow tube.

The adjusting lever (2) is pivotally connected to the inner rail (11) and comprises a first hole (21), a second hole (23), and a middle section (22) located between the first hole (21) and the second hole (23). The middle section (22) of the adjusting lever (2) is formed with a pivoting hole (221). The pivoting hole (221) of the adjusting lever (2) corresponds in position to the pivoting portion (112) of the inner rail (11). The pivoting portion (112) penetrates through the pivoting hole (221) for the adjusting lever (2) to be pivoted to the inner rail (11) in a fashion of riveting as shown in the preferred embodiment. The first hole (21) of the adjusting lever (2) corresponds in position to the first slot (111) of the inner rail (11), and the second hole (23) of the adjusting lever (2) corresponds in position to the second slot (113) of the inner rail (11). The adjusting lever (2) is pivotally connected to the inner rail (11) by means of the pivoting hole (221) engaged with the pivoting portion (112) of the inner rail (11).

The guide block (3) is pivotally connected to the second hole (23) of the adjusting lever (2). A head portion (32) with a cross-headed top is disposed on the top of the guide block (3). A protruding portion (31) is eccentrically disposed relative to the head portion (32) on the bottom of the guide block (3). A screwdriver with a cross-headed tip can be engaged with the head portion (32) to turn the guide block (3). The protruding portion (31) extends into the second slot (113) of the inner rail (11). Furthermore, a positioning mark (33) is provided on the guide block (3), and the positioning mark (33) in the preferred embodiment is a gap formed on the edge of the guide block (3).

Figure 3:
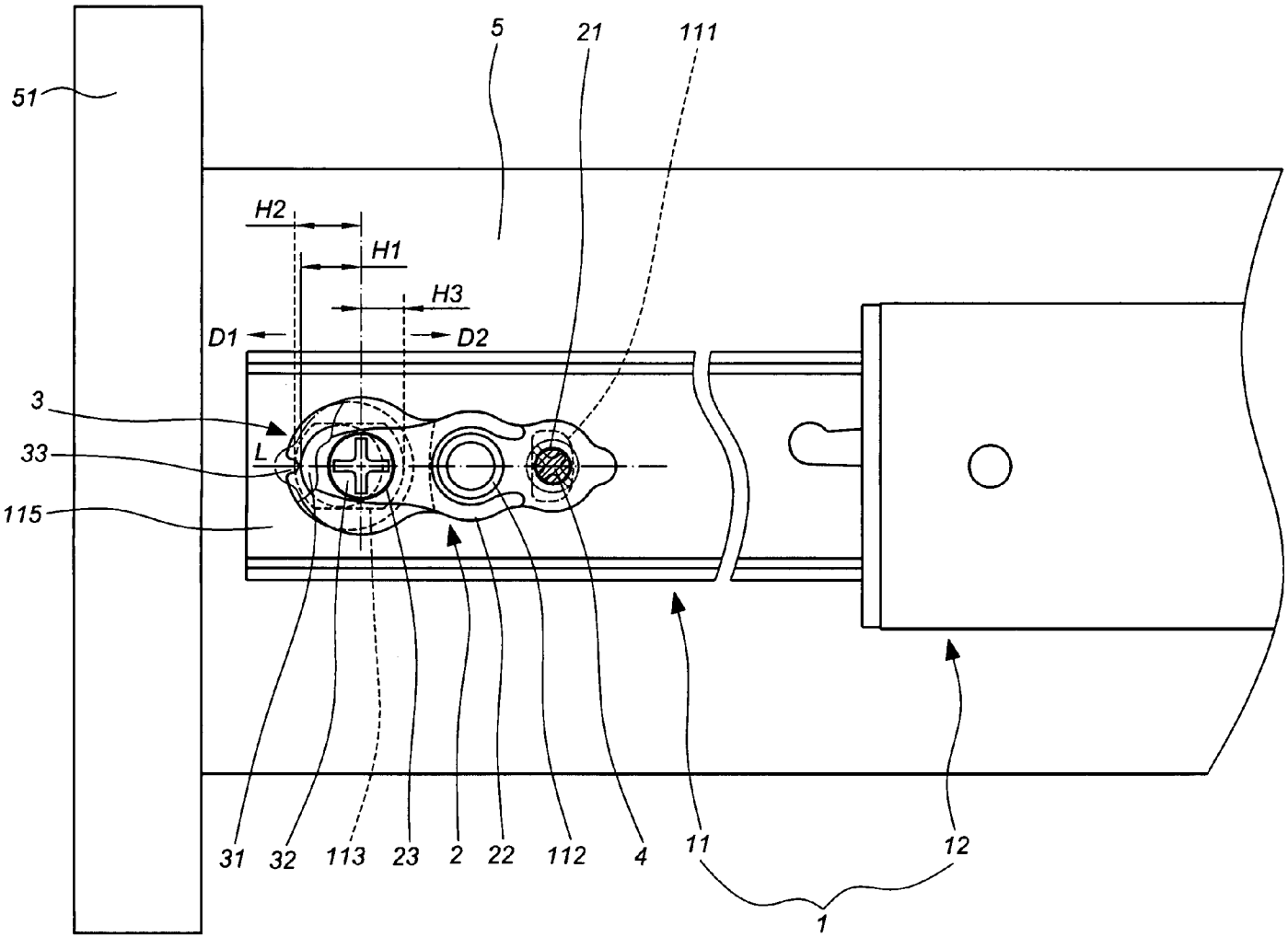
FIG. 3 is a schematic view showing that a drawer is mounted to the preferred embodiment of the present invention in a status before adjustment.

As shown in FIG. 3, the positioning mark (33) of the guide block (3) is aligned with a reference line L which is substantially a horizontal line with respect to the adjusting lever (2). The protruding portion (31) extends into the second slot (113) of the inner rail (11) and is movable against an interior surface of the second slot (113). The protruding portion (31) is located at an initial position within the second slot (113). In this embodiment of the present invention, it shows that a first longitudinal distance (H1) is defined from a central point of the head portion (32) to an edge of the protruding portion (31) in a first longitudinal direction D1, a second longitudinal distance (H2) is defined from the central point of the head portion (32) to a first edge of the second slot (113) in the first longitudinal direction D1, and a third longitudinal distance (H3) is defined from the central point of the head portion (32) to a second edge of the second slot (113) in a second longitudinal direction D2 opposite to the first longitudinal direction D1. The first longitudinal distance (H1) is smaller than the second longitudinal distance (H2), and the first longitudinal distance (H1) is larger than the third longitudinal distance (H3). Therefore, when the adjusting lever (2) is pivotally connected to the inner rail (11), the protruding portion (31) of the guide block (3) is fitted in the second slot (113) with the positioning mark (33) located towards the first longitudinal direction D1, such that the protruding portion (31) is accurately mounted within the second slot (113) of the inner rail (11) to ensure the accuracy of mounting direction.

The first hole (21) of the adjusting lever (2) corresponds to the center of the first slot (111); meanwhile, a drawer (5) is mounted to the web portion (115) of the inner rail (11) but not yet fully secured. A fastening member (4) is connected to the adjusting lever (2), and the fastening member (4) penetrates through the first slot (111) of the inner rail (11) to connect the drawer (5). For example, the fastening member (4) using a screw penetrates the first hole (21) of the adjusting lever (2) and the first slot (111) of the inner rail (11) to be secured to a side panel of the drawer (5).

Figure 4:
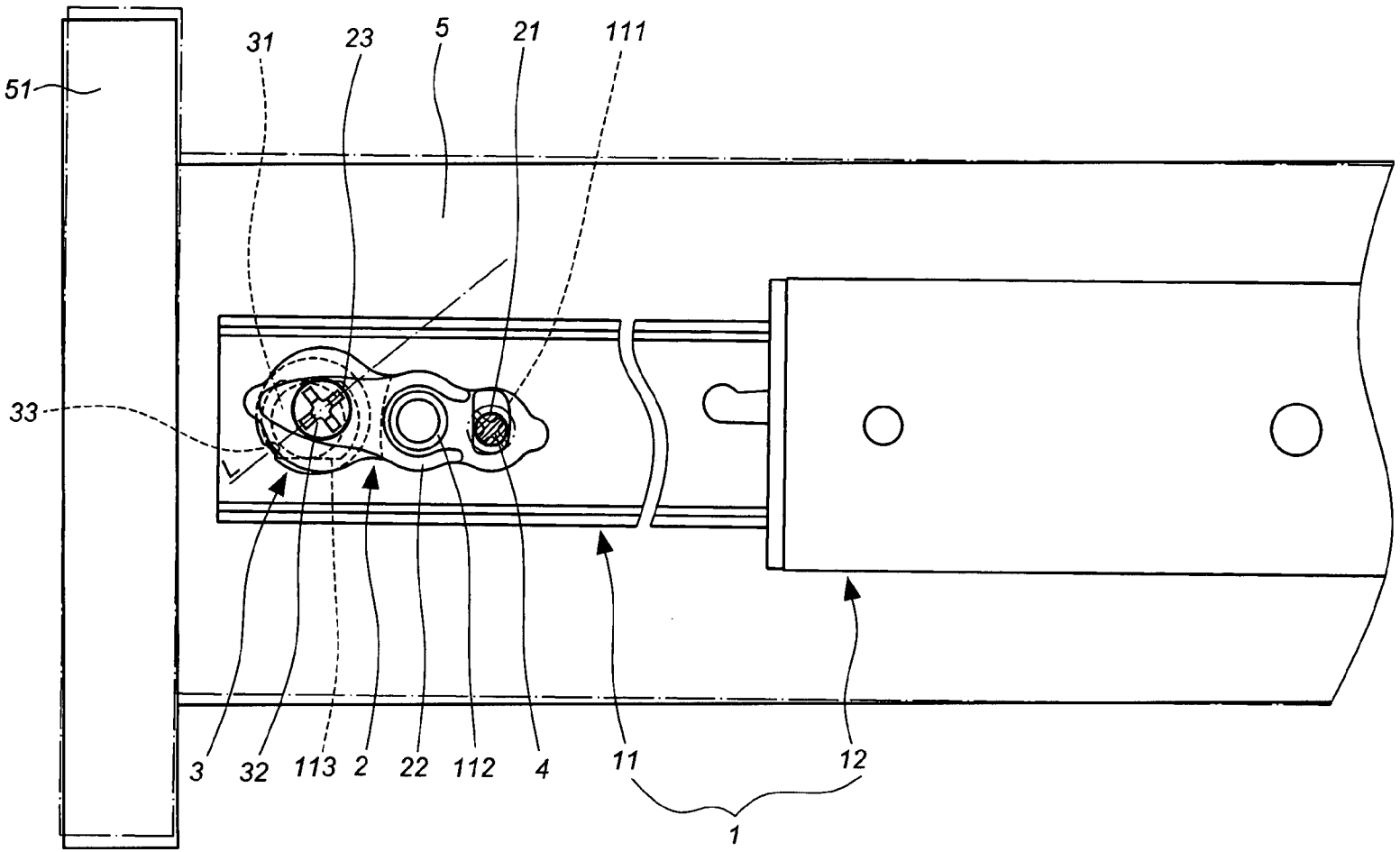
FIG. 4 is a schematic view showing an operation status of the preferred embodiment of the present invention.

When a hand tool, e.g., a screwdriver with a cross-headed tip is inserted into the head portion (32) to turn the guide block (3) for the protruding portion (31) to move against a portion of the second slot (113) as illustrated in FIG. 4. The adjusting lever (2) deflects with the pivoting hole (221) of the middle section (22) as the axis since the protruding portion (31) is eccentrically disposed; in turn the first hole (21) of the adjusting lever (2) descends to the bottom of the first slot (111) and relatively the fastening member (4) drives the front of the drawer (5) to move downward. The adjusting lever (2) becomes a lever in relation to the guide block (3) and the first slot (111) of the inner rail (11). When the guide block (3) is operated to link the second hole (23) of the adjusting lever (2), the first hole (21) of the adjusting lever (2) can be easily adjusted by taking advantage of the leverage of the adjusting lever (2). Accordingly, by having a hand tool to turn the guide block (3) allows easy adjustment of the first hole (21) of the adjusting lever (2) thus to achieve fine tuning of the position of the drawer or deck fixed to the first hole (21) of the adjusting lever (2) for higher or lower. This design of adjustment is particularly convenient in adjusting the spacing between two drawers when multiple drawers (5) stack up with the spacing between abutted panels (51) of the drawers (5) varies for them to show consistent and well coordinated appearance.

What is claimed is:

1. A slide assembly having an adjustment mechanism, comprising:

an outer rail;

an inner rail slidably connected to the outer rail, the inner rail comprising a pair of side walls and a web portion extending between the pair of side walls, wherein an end of the web portion includes a first slot, a second slot, and a pivoting portion disposed between the first slot and the second slot; wherein the web portion is adapted for placement against a drawer;

an adjusting lever pivotally connected to the pivoting portion of the inner rail, the adjusting lever comprising a first hole corresponding in position to the first slot of the inner rail, a second hole corresponding in position to the second slot of the inner rail, a middle section located between the first hole and the second hole, and a pivoting hole disposed at the middle section;

a fastening member connected to the first hole of the adjusting lever, the fastening member penetrating through the first slot of the inner rail; and a guide block pivotally connected to the second hole of the adjusting lever, the guide block comprising a head portion and a protruding portion which is eccentrically disposed relative to the head portion, wherein the protruding portion extends into the second slot of the inner rail;

wherein a first longitudinal distance is defined from a central point of the head portion to an edge of the protruding portion in a first longitudinal direction, and a second longitudinal distance is defined from the central point of the head portion to a first edge of the second slot in the first longitudinal direction, and a third longitudinal distance is defined from the central point of the head portion to a second edge of the second slot in a second longitudinal direction opposite to the first longitudinal direction;

wherein the first longitudinal distance is smaller than the second longitudinal distance, and the first longitudinal distance is larger than the third longitudinal distance;

wherein the protruding portion of the guide block is movable against a portion of the second slot when the head portion of the guide block is turned, and the fastening member is inserted through the first slot of the inner rail to connect the drawer.

* * * * *